United States Patent [19]

Hassall

[11] 3,997,062

[45] Dec. 14, 1976

[54] MULTI-SECTION TELESCOPIC JIBS

[76] Inventor: Donald Hassall, Whyteleafe, 10 Underhill Road, Cleadon, Sunderland, County Durham, England

[22] Filed: Mar. 14, 1973

[21] Appl. No.: 341,231

[30] Foreign Application Priority Data

Mar. 17, 1972 United Kingdom ..... 12543/72

[52] U.S. Cl. ..... 212/144; 91/171

[51] Int. Cl.[2] ..... B66C 23/64

[58] Field of Search ..... 212/55, 144; 60/97 E; 91/171

[56] References Cited

UNITED STATES PATENTS

| | | | |
|---|---|---|---|
| 2,761,285 | 9/1956 | Beccroft | 91/171 |
| 3,143,924 | 8/1964 | Pearson et al. | 91/171 |
| 3,609,974 | 10/1971 | Lado | 212/55 X |
| 3,657,969 | 4/1972 | Wirkus | 212/55 X |

*Primary Examiner*—Evon C. Blunk
*Assistant Examiner*—Jeffrey V. Nase
*Attorney, Agent, or Firm*—Steinberg & Blake

[57] ABSTRACT

Synchronizer apparatus is provided in or for multi-section telescopic jibs comprising travel sensors each to be carried by a moveable jib section in at least one group of at least three sections, one of the sensors being adapted for interconnection with two travel sensors carried one by each of two other sections in the group for sensing disproportionate travel of one moveable section relative to travel of a further section with respect to another section, a signal device actuable by the sensors of each group and operative means for connecting the signal device to a power transmission valve associated with rams respectively operatively connected to the said one and said further moveable sections for controlling the travel of at least one of them to remove any disproportionate travel.

4 Claims, 1 Drawing Figure

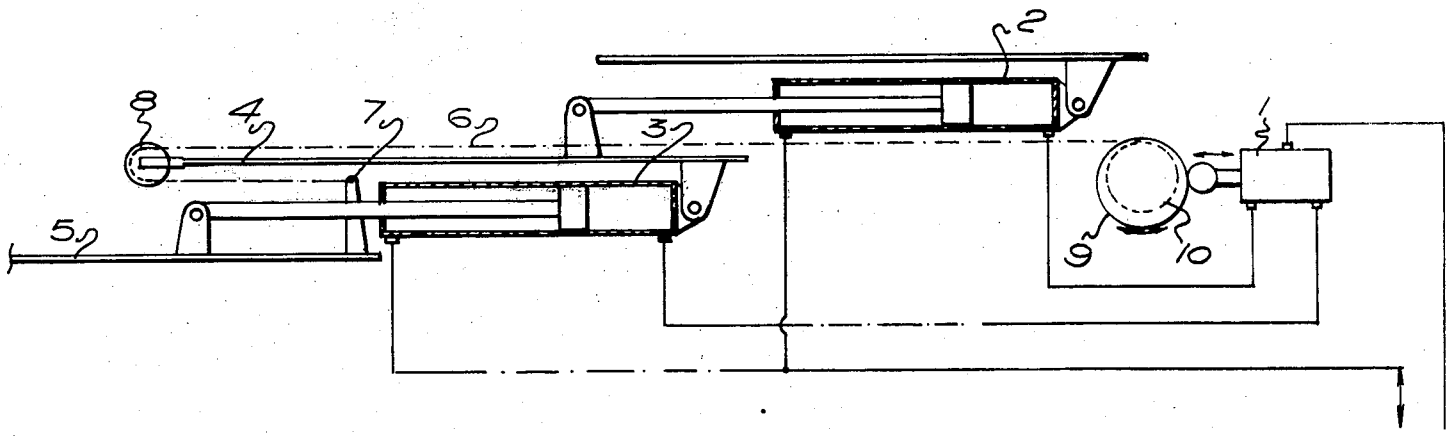
1
2
3
4
5
6
7
8
9
10

MULTI-SECTION TELESCOPIC JIBS

This invention concerns improvements in and relating to multi-section telescopic jibs having power operable extension and retraction devices.

The object of the invention is to minimize deviation from synchronization of travel of the sections during their extension and retraction and to minimize any accumulation of any such deviation after recommencing travel from partially extended positions of the sections.

Synchronization of travel of the sections may be left to the crane operator by providing individual controls for powering each section but, in order to minimize errors and relieve him of this task, some form of automatic synchronization system is frequently employed with a single operating control.

Various methods of providing such automatic synchronization have been proposed but all of these have limitations either to their application or accuracy of operation. Such methods may be regarded as being of three kinds:

i. For small jibs a convenient method is to power the jib sections with a single hydraulic ram which is coupled mechanically to the first moveable section. Subsequent moveable sections are powered by heavy duty ropes or chains on the well known 2:1 drive ratio as is commonly used on fork truck masts to provide a lift of double the ram stroke. A limitation here is the size of jibs for which this method can be used due to the physical difficulty of accommodating heavy duty chain gear within the jib structure.

ii. Use of a separate ram each connected to a common hydraulic power source, for powering each moveable section, the synchronization being carried out mechanically by less heavy rope or chain systems again using the 2:1 ratio mentioned above. Although applicable to any size of jib the synchronizing equipment may limit access for maintenance purposes and can cause problems in optimisation of the total structure.

iii. Use of a separate ram each connected to a common hydraulic power source, for powering each moveable section, the synchronization being provided by proportional dividing flow dividers for the total hydraulic flow for producing pressures as necessary to apply equal extension of each jib section. Known methods of dividing the hydraulic flow however are not completely accurate under all loading conditions and, whether a pressure compensated valve or a rotary valve divider is used, a loss of synchronization, results after a period of operation. Accurate synchronization may be achieved automatically at each end of the working range, i.e. with the sections of the telescopic jib fully extended or fully retracted; however this is not entirely satisfactory since repeated operation in the middle range, which is quite common, can lead to progressive and dangerous loss of synchronization.

According to one aspect of the invention a multi-section telescopic jib comprises a base section and moveable sections having guides for extension and retraction with respect to one another and the base section, an hydraulically operable ram operatively connected to each of the moveable sections and to a power transmission valve connectable to an hydraulic power source, in which travel sensors are carried by the sections and a travel sensor carried by a moveable section in a group of at least three sections is interconnected with two travel sensors carried one by each of two other sections in the group for sensing disproportionate travel of one of the moveable sections relative to travel of a further moveable section with respect to another section, at least one group including the base section and any successive group(s) including a section of a preceeding group, a signal device actuable by the sensors of the or each group in response to said disproportionate travel and operatively connected to the power transmission valve(s) associated with the rams operatively connected to said one and said further moveable sections for controlling the travel of one or both of these rams in the sense to remove said disproportionate travel.

According to another aspect of the invention synchronizer apparatus for the hydraulically operable multi-section jib comprises travel sensors for connection to the sections, a signal device actuable by the sensors in response to disproportionate travel of one relative to travel of a further sensor with respect to another and operative means for connecting the signal device to the power transmission valve(s).

The synchronizer apparatus may be fitted to multi-section telescopic jibs of the kind (ii) referred to, power transmission valve(s) also being provided for connection in the hydraulic supply pipes to the rams in lieu of the rope or chain system.

The power transmission valve(s) may each comprise a three way variable divider valve e.g. for variably dividing flow in a power supply pipe between two supply pipes i.e. ram and supply pipes, connected on to each of the associated rams. Alternatively or additionally a variable restrictor valve may be connected to each or at least one of the ram supply pipes.

The synchronizer apparatus may also be fitted to multi-section telescopic jibs of the kind (iii) referred to, a variable restrictor valve usually also being provided for connection in the ram supply pipes rather than connecting the signal device to a several way proportional flow divider valve.

The variable divider valve and/or variable restrictor valve may be off/on control valves, especially when provided in synchronizer apparatus for use with divider valve compensation circuitry which is in good condition, e.g. installed in jibs of the kind (iii) referred to. In cases where an off/on quick action divider valve is provided for ram supply pipes an additional off/on quick action restrictor valve would normally not be required for those pipes, but could be provided for operative connection to a further signal device, e.g. associated with a successive group of section.

It will be appreciated that operation of a variable restrictor valve consequent upon minor disproportionate travel of a section will not usually vary the setting of a variable divider valve in addition to which it is provided in a rain supply pipe so that upon synchronization of travel being restored and consequent return of the variable restrictor valve to its initial position, the variable divider valve will resume its predetermined proportional flow division without any time lag caused by its assuming a different position e.g. returning to its initial position which, other things being equal, it will have maintained.

The rams are preferably double acting i.e. double acting piston and cylinder assemblies, for alternatively powering extension and retraction travel of the sections although additional signal device(s) and power transission valve(s) may be provided for separate rams or the respective ends of double acting rams, for retraction separately from extension of the sections, a direction sensor is preferably provided operative to reverse the sense of variation of the power transmission valve(s) in respect to the sensors according to whether extension or retraction of the sections is to be synchronized.

The or each power transmission valve, e.g. variable divider valve may have two portions alternatively operative in opposite senses e.g. connection with non-return valves for selection according to the direction and flow and/or connected respectively in part of a supply pipe and in an additional supply pipe connection in parallel therewith. Thus an additional supply pipe having a non-return valve may be of a supply pipe provided with a non-return valve operative in the opposite sense to that in the additional supply pipe, one or both of the non-return valves constituting the direction sensor. Alternatively the additional supply pipe may be connected by a three way valve operative by a direction sensor for example the extension/retraction gear connected with the hydraulic supply.

At least the moveable sections of a group of sections are preferably adjacent in the multi section jib and usually three adjacent sections form a group. Any successive group(s) normally has two sections in common with a preceeding group. The or each signal device is then normally operative on power transmission valve(s) in the ram supply pipe(s) to two rams, connected respectively between said one moveable section and the further adjacent, moveable section and between the further moveable section and another section preferably adjacent to it. Sensors are normally provided on all the sections.

As heretofore each ram is preferably connected between adjacent sections in the multi-sections jib and the section may each travel an equal amount from the preceeding section.

An embodiment the travel sensors comprise a light wire or rope connected at one end to one moveable section of a group of sections, reeved in a pulley system having a ratio corresponding to the number and spacing of the sections in the group and associated with a further moveable section and connected at the other end round the periphery of a drum carried on the base section. The drum is connected to a cam so as to signal disproportionate travel, apparent in rotation of the drum, to the cam which operates a power transmission valve — a three way flow divider valve — connected to a ram supply pipe common to the double acting rams operationally connected to said one and said further moveable sections.

This embodiment will be further described with reference to the accompanying drawing showing two moveable sections, but it will be appreciated that the principles can be extended to control any number of moveable sections by the addition of the relevant extra equipment.

The relative movement of the two jib sections is controlled by a differential displacement error reset signal operating on a hydraulic metering valve 1 passing oil to or from the piston ends of two hydraulic cylinder 2 and 3 which extend adjacent the jib sections 4 and 5 respectively.

Also shown is one convenient method of obtaining a suitable error signal for operation of the metering valve. This consists of a wire loop 6 attached at 7 to the rear end of jib section 5 and passing over a pulley 8 attached to the front end of jib section 4 and having the other end attached to a spring loaded rotating drum 10 around which it passes a number of times.

When the two jib sections travel each with respect to the next following or each with respect to the next preceding section by an equal amount the drum 10 is not rotated but if section 5 for example moved out more than 4 the drum would be rotated in a clockwise direction. This rotation of the drum 10 is used to control the position of a metering valve 1 through the action of cam plate 9 attached to drum 10. The movement of a spool in valve 1 is arranged such that clockwise rotation of the cam diverts extra fluid into ram 2 such that jib section 4 regains correct synchronization with section 5. In this configuration the mid position of the spool or valve 1 which is spring loaded against the cam plate, corresponds with mid lift position of the cam such that similar but opposite spool motion takes place in event of jib section 4 getting ahead of section 5.

It will be appreciated that since the metering valve controls flow in both directions i.e. for both extension and retraction of the jib, means for sensing the direction and reversing the effect of the error signal are provided. In the system described above using a directly operated metering valve this is provided simply by what is literally a double metering valve one portion of which operates for extension and one for retraction. The controlling elements (or portions) are selected automatically by the flow of the oil operating non-return valves.

It will be appreciated that the error or disproportions travel signal can be used in other ways to obtain the same end result. For example the cam can be arranged to operate a remotely located metering valve by the use of a pilot pressure system. Alternatively or additionally the error signal can be arranged to actuate the metering system electrically, e.g. by the use of a variable potential signal and solenoid operated valves, or pneumatically or hydraulically. In this case the reversing action previously referred to can be achieved electrically or hydraulically or pneumatically, if not mechanically.

It will be appreciated that the error signal system may be applied as a correction to conventional methods of flow dividing whereby the signal is set merely to correct the error which remains in the output from the rotary or valve type divider employed in jibs of the kind (iii) referred to.

The light wire or rope described does not unduly restrict access to the jib. However, electrically responsive sensors, e.g. potentiometers, may be alternatively employed or hydraulic or pneumatic sensors.

The system may be arranged such that a relatively small error of synchronization will completely close off the supply to the 'leading' section such that the 'lagging' section must progress into synchronization in the shortest possible time. With such a system there can be no question of progressive deterioration of synchronization and in any case there will be no accumulations of any deviations from proportionate travel.

Thus, as may be seen from the drawings, the section 4 may be considered as an intermediate section situated between the immediately preceding section shown at the upper right of the drawing and pivotally connected through a suitable bracket with the cylinder of the hydraulic moving means 2 which is connected between this immediately preceding section and the intermediate section 4. In the same way the section 5 may be considered as a section immediately following the intermediate section 4 and the hydraulic moving means 3 is interconnected between the intermediate section 4 and the immediately following section 5. The section immediately preceding the section 4 may be considered as a stationary section with respect to which the valve 1 and the controls 9,10 are also stationary so that there is no relative movement between the valve and the controls and the section immediately preceding the intermediate section 4. Thus, the moving means 2 interconnected between the intermediate section 4 and the immediately preceding section should move the intermediate section with respect to the immediately preceding section to the same extent that the moving means 3 moves the next following section 5 with respect to the intermediate section 4. The cable 6 together with the drum 10 and the cam 9 form a means for detecting automatically when the extent of movement of the intermediate section 4 with respect to the immediately preceding section is not equal to the extent of movement of the immediately following section 5 with respect to the intermediate section 4. When such an inequality of movement between the sections is detected by this detecting means, it automatically actuates the valve means 1 to control the pair of moving means 2 and 3 in order to restore the equality of relative movement between the intermediate section and the immediately preceding section, on the one hand, and the intermediate section and the immediately following section, on the other hand. Thus, the means 1 forms a control means automatically actuated by the detecting means 6,9,10 for controlling the pair of moving means 2,3 for automatically restoring equality of relative movement between the several sections when an inequality in this relative movement is detected by the detecting means.

I claim:

1. In a retractable and expandable assembly, a plurality of sections movable one with respect to the next, said plurality of sections including at least an intermediate section, a preceding section immediately preceding said intermediate section, and a following section immediately following said intermediate section, a pair of moving means one of which is interconnected between said preceding and intermediate sections for moving said intermediate section with respect to said preceding section, and the other of which is interconnected between said intermediate section and following section for moving said following section with respect to said intermediate section, control means operatively connected with said pair of moving means for controlling the extent to which said one moving means moves said intermediate section with respect to said preceding section and the extent to which said other moving means moves said following section with respect to said intermediate section, said control means being fixed only with respect to said preceding section while said intermediate and following sections are both movable with respect to said control means, and detecting means operatively connected at least with said intermediate and following sections and operatively connected to said control means for detecting when there is an inequality of movement between said intermediate and following sections, on the one hand, and said intermediate and preceding sections, on the other hand, and automatically actuating said control means to control at least one of said pair of moving means for restoring equality of movement between the intermediate section and the following section, on the one hand, and said intermediate section and preceding section, on the other hand.

2. The combination of claim 1 and wherein said detecting means includes a cam means which automatically moves in response to detection of said inequality, said cam means operating on said control means to actuate the latter for restoring said equality.

3. The combination of claim 2 and wherein said detecting means further includes a cable connected at one end to said following section, said intermediate section carrying a pulley around which said cable extends, and a drum connected with said cam means for turning the latter and connected to said cable, said drum and cam means having a common axis around which said drum and cam means rotate, said axis being stationary with respect to said control means and said preceding section.

4. The combination of claim 3 and wherein said pair of moving means are in the form of hydraulic rams, and said control means being in the form of a valve means which is acted upon by said cam means for controlling the flow of hydraulic fluid to said rams for maintaining automatically said equality of relative movement.

* * * * *